US005080015A

United States Patent [19]

Hansson et al.

[11] Patent Number: 5,080,015

[45] Date of Patent: Jan. 14, 1992

[54] METHOD AND ARRANGEMENT FOR CLEANING GUIDE ROLLERS

[75] Inventors: Birger Hansson, Åkarp; Sten Hultberg, Malmö, both of Sweden

[73] Assignee: Jimek International AB, Malmö, Sweden

[21] Appl. No.: 501,753

[22] Filed: Mar. 30, 1990

[30] Foreign Application Priority Data

Oct. 10, 1989 [SE] Sweden ..... 890330

[51] Int. Cl.[5] ..... B41F 35/00

[52] U.S. Cl. ..... 101/483; 101/425; 101/424

[58] Field of Search ..... 101/423, 424, 425, 483; 239/255, 261, 550, 551, 566

[56] References Cited

U.S. PATENT DOCUMENTS

| | | | |
|---|---|---|---|
| 2,408,449 | 10/1946 | Russell | 101/147 |
| 4,651,644 | 3/1987 | Kaempfe et al. | 101/425 |
| 4,781,116 | 11/1988 | Harada | 101/425 |
| 4,930,415 | 6/1990 | Hara et al. | 101/425 |
| 4,981,078 | 1/1991 | Dettinger et al. | 101/425 |

FOREIGN PATENT DOCUMENTS 58-92566 6/1983 Japan .

*Primary Examiner*—Edgar S. Burr
*Assistant Examiner*—Christopher A. Bennett
*Attorney, Agent, or Firm*—Pollock, Vande Sande & Priddy

[57] ABSTRACT

The invention relates to a method for removing printing ink from guide rollers in a printing press. As a paper web moves along its normal path through the printing press while printing is suspended, a printing ink solvent is sprayed onto the paper web, either upstream or downstream of a printing machine. The printing ink deposits on the rollers are dissolved by the solvent as the sprayed paper web passes over the rollers, and the dissolved printing ink is then wiped from the rollers with a nonsprayed part of the paper web. In accordance with one preferred embodiment, the solvent is sprayed onto the paper web in one or more sinusoidal paths and the guide rollers are subsequently braked, preferably to a complete stop and preferably pulse-wise when the sprayed part of the web and the wiping part of the web passes over the rollers. The duration of the pulses is adapted to the desired cleaning effect.

8 Claims, 4 Drawing Sheets

METHOD AND ARRANGEMENT FOR CLEANING GUIDE ROLLERS

BACKGROUND OF THE INVENTION

The present invention relates to a method and an arrangement for cleaning the guide rollers of printing presses.

In conventional presses, the web of printing paper to be printed on passes from a feed roller, through the printing machine in which the paper is printed on one or both sides thereof, and thereafter, when printing is completed, over one or more guide rollers to a paper-folding mechanism where the printed paper web is cut and folded. The guide rollers are either freely rotating or motor-driven for rotation. Several tens of such rollers may be provided for guiding each paper web between the printing machine and the folding mechanism.

These guide rollers are dirtied successively with printing ink from the paper print. Consequently, it is necessary to remove these ink deposits regularly from the guide rollers, so as to prevent pleating or scrinkling of the paper web and the transfer of ink deposits onto the web. Various methods for cleaning such guide rollers manually are known in the art. For instance, subsequent to removing the paper web, the guide rollers can be scraped free of such deposits, either with or without the aid of a cleansing agent. This cleansing method is both laborious and highly time consuming, and also very expensive.

Several methods of removing printing ink from printing rollers mechanically are also known in the art. Examples of such methods are found in U.S. Pat. Nos. 4,058,059, 4,344,361 EP O 257 818, SE 455 396, SE 417 298, U.S Pat. No. 3,120,805 and Pat. No. 2,731,916. In principle, the methods taught by these publications involve applying a movable cleaning device to a dirty printing roller. Printing-ink solvent is transferred from the cleaning device to the printing roller, either by spraying or by brushing with the aid of brushes. The solubilized printing-ink is wiped from the roller with a cloth or with paper provided in rollform on the cleaning device, or is scraped-off with brushes or knives on the device. The described methods, however, are suitable only for cleaning printing rollers. A cleaning unit of the described kind is much too bulky and expensive for use in cleaning relatively small and relatively many guide rollers. Furethermore, the majority of cases, the use of such a cleaning unit requires that the paper web be removed from the guide rollers.

SUMMARY OF THE INVENTION

The present invention provides a method and an arrangement for cleaning guide rollers which circumvents the above problem and with the aid of which guide rollers can be cleaned much more quickly, more positively, and more effectively than with prior known methods and arrangements, without need to for removing the paper web.

The invention will now be described in more detail with reference to non-limiting, exemplifying embodiments thereof and with reference to the accompanying drawings.

DETAILED DESCRIPTION OF THE PREFERRED EMBODIMENTS

Figure 1:
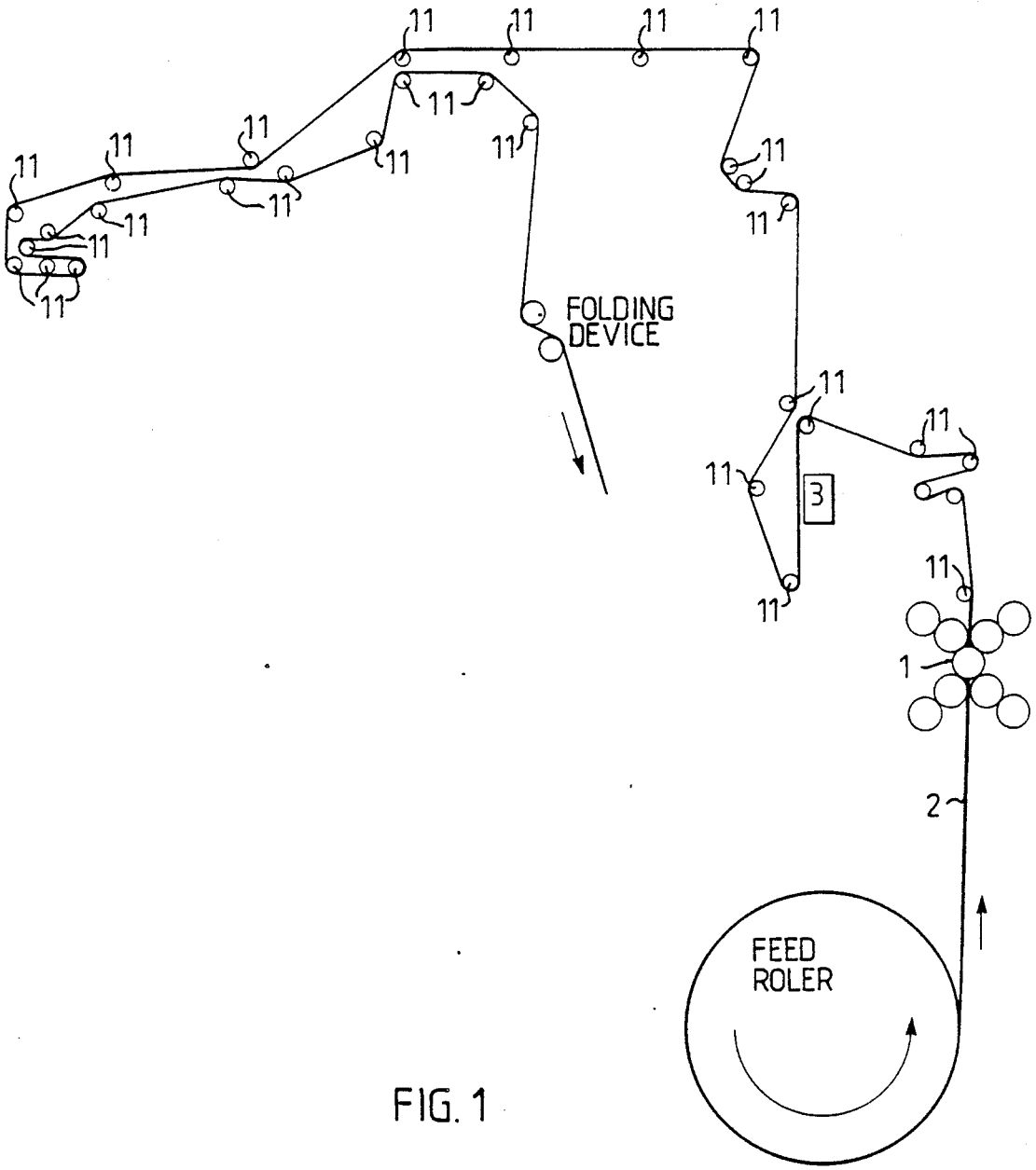
FIG. 1 illustrates schematically the construction of a printing press and shows the path travelled by the paper web between different units incorporated in the press.
Figure 2:
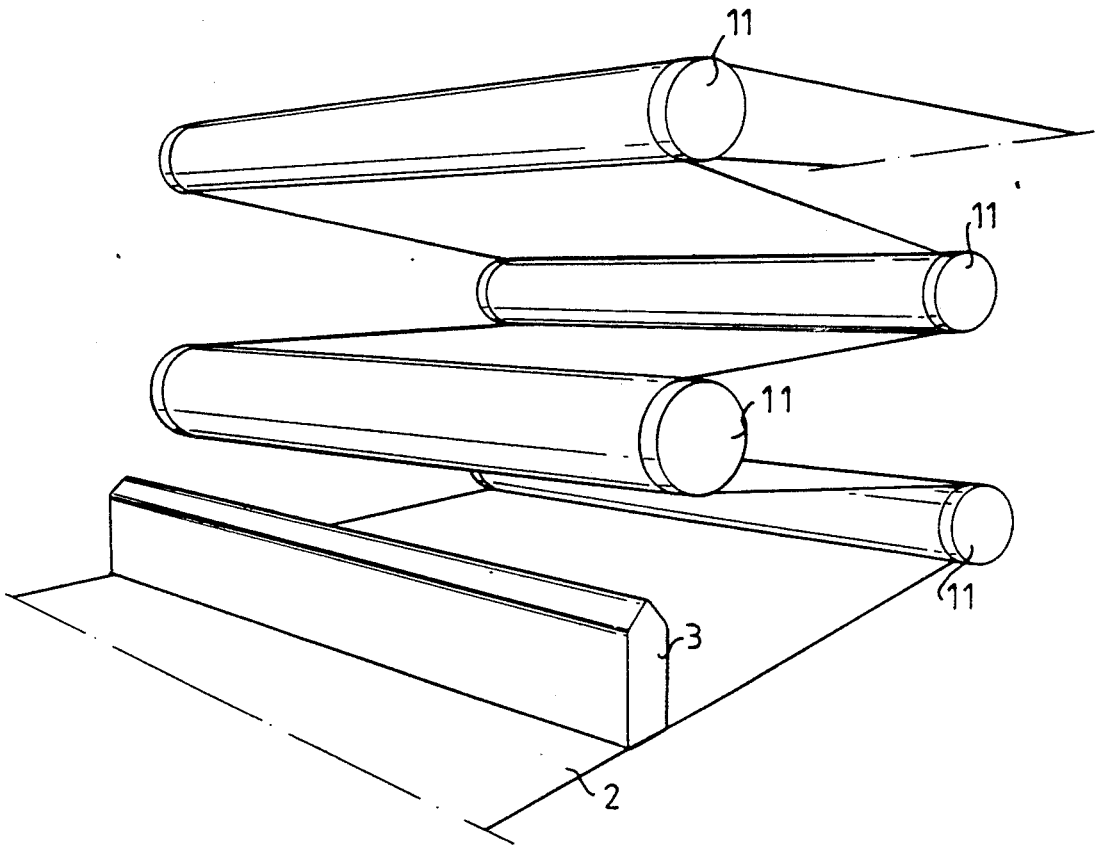
FIG. 2 illustrates in perspective possible positioning of guide rollers in a printing press.
Figure 3:
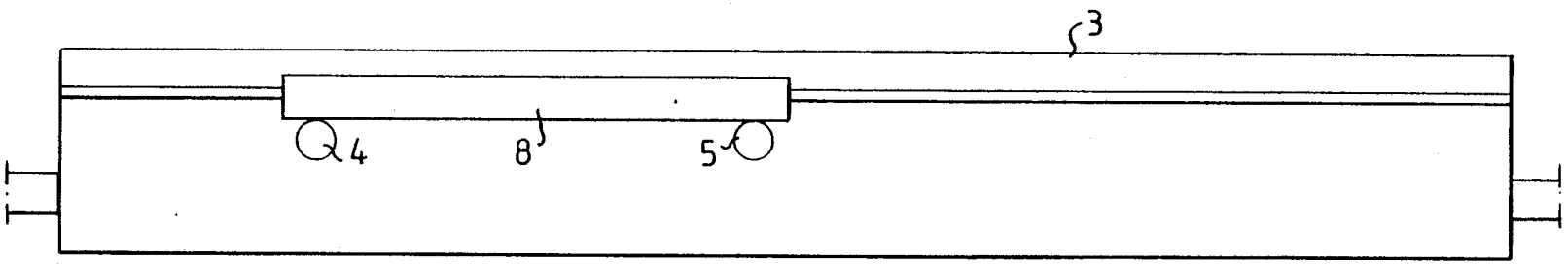
FIG. 3 is a longitudinal, sectional view of a spray device forming part of the invention, and shows the device facing towards the paper web.
Figure 4:
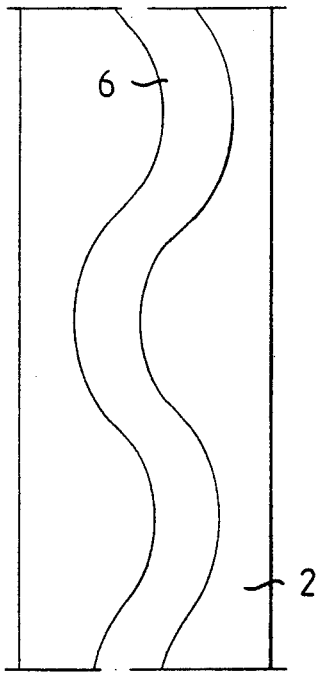
FIG. 4 illustrates schematically the configuration of a narrow paper web sprayed in accordance with a first embodiment of the invention described herebelow.
Figure 5:
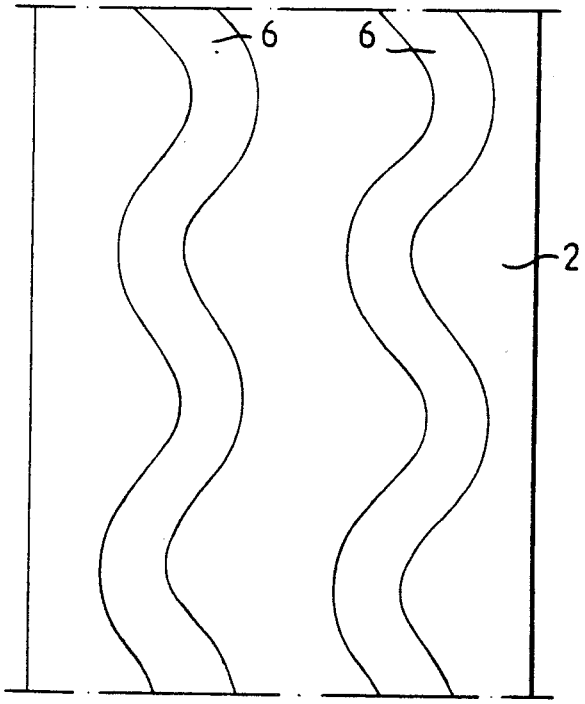
FIG. 5 illustrates schematically the configuration of a broad paper web sprayed in accordance with the first embodiment described herebelow.

A paper web 2 is advanced from the printing machine 1 past a spray device 3 which is equipped with one or more nozzles, of which only two 4 and 5 are shown, and which is operative to spray a cleansing agent 6 onto the paper web 2. To this end, the spray device may alternatively be positioned adjacent a part of the paper web 2 located before the printing machine 1. The cleaning agent 6 consists of a substance which will not weaken the paper web 2, and may, for instance, consist of a mineral-oil fraction which constitutes a solvent for a number of printing inks. When the paper web 2 has a narrow width, the cleaning device operates with solely one nozzle 4 or 5. When the web has a wide width, the cleaning device operates with several nozzles.

The nozzles 4,5 are fixedly mounted on a rod 8. In operation, the nozzles 4,5 will be held constantly at a mutual distance apart. An advantage is afforded, however, when nozzle spacing can be changed when spraying is not being carried out. When the spraying device is operational, the nozzles 4,5 can either have fixed positions, in relation to the spraying device 3, or can be moved back and forth, either intermittently or continuously along substantially the whole length of the spray device 3 between its first and second end in different ways, with the aid of the movable rod 8.

In the case of a first and preferred embodiment, the paper web 2 is sprayed along a length thereof adapted to the respective cylindrical surfaces of the, downstream guide rollers, to the number of the rollers present and to the extent to which the rollers are soiled. Spraying is effected while the piston rod 8 moves the nozzles 4,5, continuously back and forth along the spraying device 3. The sprayed regions of the paper web 2 will therefore have a sinusoidal configuration as indicated at 9 and 10.

When the sprayed portion of the paper web 2 reaches the guide rollers 11, the rollers are successively braked pulsewise, so that the tangential speed of the rollers will differ from the speed of the paper web 2 during application of the braking pulses. The best effect is achieved when the rotational speed of the rollers 11 is braked so that the rollers 11 are brought pulsewise to a complete standstill. The pulses are preferably of variable duration adapted to the desired cleaning effect. Alternatively, or complementary hereto, the guide rollers 11 can be displaced back and forth continuously back and forth while the sprayed part of the web 2, in a direction perpendicular to the direction of movement of the web 2. In this case, the cleaning agent 6 is transferred to the rollers 11 by virtue of the sinusoidal configuration of the sprayed regions, in a manner such that a part of the ink on the rollers 11 moistened by the cleaning agent or solvent 6 will be wiped-off, almost immediately, by a non-moistened part of the web. This enables printing ink on the guide rollers 11 to be moistened and wiped-off in one single step and with the least possible paper consumption.

In accordance with another embodiment, the paper web 2 is, instead, sprayed with the nozzles 4,5 placed in fixed positions relative to the spray device 3, wherewith the paper web 2 is saturated with cleaning agent 6 substantially across the whole width of the web. In case, the guide rollers 11 are first moistened with cleaning agent 6 and are then wiped clean by a following non-sprayed part of the web 2 in a separate step.

When the web 2 has passed through all of the guide rollers 11 present, the consequently soiled paper is scrapped and printing is recommenced with no time wastage.

Braking of the guide rollers 11, preferably so that the rollers are brought to a complete stop, is controlled in the case of the first embodiment preferably in a pulse-wise fashion and only when the guide rollers 11 are in contact with sprayed paper 2, and in the case of the second embodiment also during subsequent wiping of the rollers with non-sprayed parts of the web 2, and such that at most the number of guide rollers 11 braked simultaneously, preferably to a complete stop, will not exceed the number at which the paper web 2 will rupture.

The invention has been described in the aforegoing with reference to the cleaning of guide rollers in printing presses. It will be obvious, however, that the method can also be applied for cleaning other devices which come into contact with a moving web of paper, cloth, fibres and the like, and that modifications can be made within the scope of the inventive concept.

We claim:

1. A method for cleaning guide rollers forming part of a printing press having a printing machine and including a web of printing paper comprising the steps of:

(a) moving the paper web along its normal printing path in the printing machine without being printed upon;

(b) passing the paper web through said spray device which extends longitudinally across the width of the paper web and includes at least one nozzle by means of which a given length of the paper web is sprayed, on at least one side thereof with a printing-ink solvent solution;

(c) moving said nozzle back and forth along the length of said spray device such that the solvent is deposited on the moving paper web in a form of substantially sinusoidal path;

(d) passing the paper web over at least one guide roller, whereby transferring the solvent to said roller such as to dissolve printing ink deposited thereon;

(e) wiping ink from the guide rollers by unsprayed parts of the paper web;

(f) braking said guide rollers with pulses of variable duration during the passage of said paper web over said guide rollers for the purpose of depositing solvent on said guide rollers or for wiping printing-ink therefrom, such as to obtain a tangential speed of said guide rollers different from the speed of the paper web;

(g) selecting said pulses of variable duration to provide a desired cleaning effect;

(h) scrapping the part of the paper web wetted with solvent and soiled with printing ink; and (i) commencing printing of the untouched part of the paper web without changed to the paper web.

2. A method for cleaning guide rollers according to claim 1, wherein spraying of the paper web is effected with said at least one nozzle moving continuously back and forth along substantially the whole length of the spray device to deposit said solvent on the paper web in said substantially sinusoidal path, whereafter saturation of the guide rollers with solvent and wiping of dissolved printing ink from the guide rollers takes place simultaneously and in a sequence resulting in the least possible consumption of the paper web for cleaning the guide rollers.

3. A method for cleaning guide rollers according to claim 1, wherein said spraying of the paper web is effected intermittently.

4. A method for cleaning guide rollers according to claim 2, further comprising the step of controlling the length of the paper web sprayed with said solvent in dependence on the number of guide rollers to be cleaned and the total area of their cylindrical surfaces and also in dependence on the extent to which said rollers are soiled.

5. A method for cleaning rollers according to claim 1, further including applying braking force necessary to bringing said guide rollers to a total stop and selecting the number of rollers which are braked simultaneously such as to prevent rupture of the paper web.

6. A method for cleaning guide rollers according to claim 1, wherein the tangential speed of the guide rollers differs pulsewise from the speed of said paper web.

7. A method for cleaning guide rollers according to claim 1, wherein the tangential speed of the guide roller is equal to zero.

8. A method for cleaning guide rollers forming part of a printing press having a printing machine and including a web of printing paper comprising the steps of:

(a) moving the paper web along its normal printing path in the printing machine without being printed upon;

(b) passing the paper web through said spray device which extends longitudinally across the width of the paper web, and includes at least one nozzle by means of which a given length of the paper web is sprayed, on at least one side thereof with a printing-ink solvent solution;

(c) moving said nozzle back and forth along the length of said spray device such that the solvent is deposited on the moving paper web to form a substantially sinusoidal path;

(d) passing the paper web over at least one guide roller, whereby transferring the solvent to said roller such as to dissolve printing ink deposited thereon;

(e) wiping ink from the rollers by unsprayed parts of the paper web;

(f) continuously moving said guide rollers back and forth in the same plane as the paper web and perpendicularly to the direction of movement of the paper web during the passage of said paper web over said guide rollers for the purpose of depositing solvent on said guide rollers or for wiping printing-ink therefrom, said movement being controlled pulse-wise with the duration of pulses being adapted to a desired cleaning effect;

(g) scrapping the part of the paper web wetted with solvent and soiled with printing ink; and (h) commencing printing of the untouched part of the paper web without change to the paper web.

* * * * *